US008960141B2

(12) United States Patent
Luedemann et al.

(10) Patent No.: US 8,960,141 B2
(45) Date of Patent: Feb. 24, 2015

(54) ADJUSTMENT SHAFT ACTIVATION OF A VALVE OPERATION FOR COMBUSTION ENGINES FOR OPERATING GAS EXCHANGE VALVES

(71) Applicant: IAV GmbH Ingenieurgesellschaft Auto und Verkehr, Berlin (DE)

(72) Inventors: Jochen Luedemann, Chemnitz (DE); Uwe Parsche, Chemnitz (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 0 days.

(21) Appl. No.: 13/941,585

(22) Filed: Jul. 15, 2013

(65) Prior Publication Data

US 2015/0013629 A1 Jan. 15, 2015

(51) Int. Cl.
*F01L 1/34* (2006.01)
*F01L 1/344* (2006.01)

(52) U.S. Cl.
CPC ..... *F01L 1/344* (2013.01)
USPC ..... 123/90.17; 123/90.15

(58) Field of Classification Search
USPC ..... 123/90.15, 90.16, 90.17, 90.31
See application file for complete search history.

(56) References Cited

U.S. PATENT DOCUMENTS

| | | | | |
|---|---|---|---|---|
| 8,225,759 | B2 | 7/2012 | Wutzler et al. | |
| 2007/0034184 | A1 * | 2/2007 | Dengler | 123/90.17 |
| 2011/0180029 | A1 | 7/2011 | Arnold et al. | |

FOREIGN PATENT DOCUMENTS

| | | | |
|---|---|---|---|
| DE | 102008061440 | B3 | 6/2010 |
| DE | 102009057691 | A1 | 6/2011 |
| DE | 102010005790 | A1 | 7/2011 |

* cited by examiner

*Primary Examiner* — Zelalem Eshete
(74) *Attorney, Agent, or Firm* — Leydig, Voit & Mayer, Ltd.

(57) ABSTRACT

An adjusting shaft actuating device of a valve train for internal combustion engines includes a cam unit with first and second cams rigidly connected thereto. The second cam is spaced apart from the first cam in axial and peripheral directions. The device also includes a lever unit non-rotatably arranged on an adjusting shaft with first and second lever arms rigidly connected thereto. The second lever arm is spaced apart from the first lever arm in axial and peripheral directions. The first and second cams are configured to be brought into respective operative connections with the first and second lever arms by an axial alignment between the cam unit and lever unit. The first and second cams and the first and second lever arms are arranged such that the first operative connection and the second operative connection are produced during a rotation of the adjusting shaft in a temporally consecutive manner.

7 Claims, 1 Drawing Sheet

ADJUSTMENT SHAFT ACTIVATION OF A VALVE OPERATION FOR COMBUSTION ENGINES FOR OPERATING GAS EXCHANGE VALVES

FIELD

The present invention relates to a device for actuating adjusting shafts of stroke-switchable valve trains of internal combustion engines.

BACKGROUND

Valve train devices are known having a mechanism for switching over the stroke of gas exchange valves. The invention is based on a valve train, in which the gas exchange valves, in particular inlet valves and outlet valves of an internal combustion engine, are directly or indirectly actuated by means of a camshaft. To switch over the valve stroke, adjacent cams with different cam shapes, which are combined to form a cam unit, are provided on the camshaft. By means of an axial displacement of the cam units on the camshaft, the stroke of the gas exchange valves is varied in accordance with the contour of the cams. For the displacement of the cam units, an adjusting shaft running parallel to the camshaft with corresponding elements for engagement on the axially displaceable components, for example cam units, is provided. The adjusting shaft is rotatably mounted in a housing parallel to the camshaft in a plurality of shaft bearings. A housing can be taken to mean a cylinder head, a ladder-type frame, modules or other mechanisms for receiving an adjusting shaft. At least one adjusting mechanism, which is associated with a cam unit for the direct or indirect actuation of gas exchange valves, is mounted on the adjusting shaft.

A rotatable adjusting shaft, which is arranged parallel to a camshaft, on which adjusting shaft two adjusting mechanisms are non-rotatably arranged and two drivers that can be axially displaced on the adjusting shaft for switching over the valve between two different cam profiles of a cam assembly, which is axially displaceable on the camshaft, are arranged between the adjusting mechanisms, is described in the patent DE 10 2008 061 440 B3. By rotating the adjusting shaft, the drivers are axially displaced on the adjusting shaft, the rotation taking place by means of the camshaft. For this purpose, a toothed wheel, which is non-rotatable but axially displaceable and which, to rotate the adjusting shaft, is brought into engagement with a tooth segment arranged on the camshaft by means of a drive arranged on the adjusting shaft, is arranged on the adjusting shaft.

An adjusting shaft arranged parallel to a camshaft, which can be connected by means of a control gear to the camshaft, so the adjusting shaft, when an operative connection is produced to the camshaft, can be rotated thereby, so a cam assembly provided with different cam profiles is axially displaced on the camshaft by means of drivers and a switching gate, is known from patent application DE 10 2009 057 691 A1. The control gear according to the invention to connect and separate the camshaft with respect to the adjusting shaft consists of a one-armed or multi-armed lever system and a profiled gate part. The lever system is rigidly arranged on the adjusting shaft. The gate part is non-rotatably and axially displaceably arranged on the camshaft, it being possible to bring it into engagement by means of an actuator with the lever system in a switchable manner and to separate it.

The drawback of the technical solutions known from the prior art is the high installation space requirement necessary to rotate the adjusting shaft. These solutions can therefore only be used with correspondingly configured cylinder head hoods or adequately large rotation installation space in the region of the adjusting shaft to be able to accommodate the corresponding components.

SUMMARY

In an embodiment, the present invention provides an adjusting shaft actuating device of a valve train for internal combustion engines includes a cam unit non-rotatably arranged on the camshaft with first and second cams rigidly connected to the cam unit. Each cam includes an outer contour rising in a rotational direction and the second cam is spaced apart from the first cam in an axial direction and a peripheral direction. The device also includes a lever unit non-rotatably arranged on an adjusting shaft with first and second lever arms rigidly connected to the lever unit. Each lever unit includes an outer contour and the second lever unit is spaced apart from the first lever unit in an axial direction and a peripheral direction. By an axial alignment between the cam unit and lever unit, the first cam is configured to be brought into a first operative connection with the first lever arm and the second cam is configured to be brought into a second operative connection with the second lever arm. The first and second cams and the first and second lever arms are arranged such that the first operative connection of the first cam and first lever arm and the second operative connection of the second cam and second lever arm are produced during a rotation of the adjusting shaft in a temporally consecutive manner.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
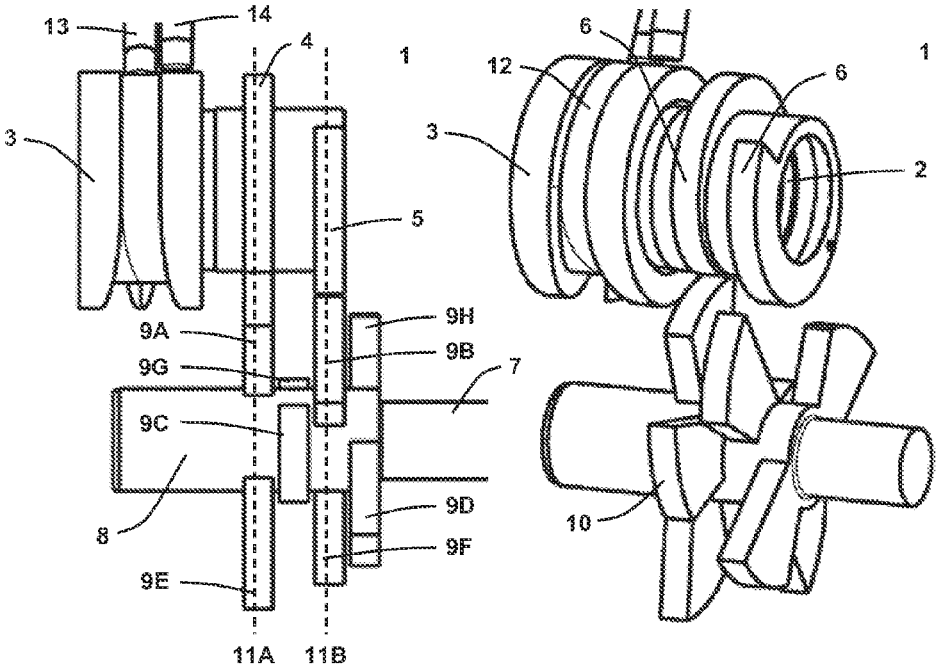
FIG. 1 shows a schematic view of an adjusting shaft actuating device during a state of a first alignment and FIG. 2 shows a schematic view of the adjusting shaft actuating device during a state of a second alignment.

An aspect of the present invention is to provide a device for actuating an adjusting shaft for a valve train to switch over the stroke of gas exchange valves of an internal combustion engine, in which the required rotation and axial installation space in the region of the adjusting shaft is to be reduced.

In an embodiment, the present invention provides a device, with which an adjusting shaft of a stroke-switchable valve train can be actuated in a particularly advantageous manner. The actuating device according to the invention for the adjusting shaft is, for this purpose, at least assembled from a lever unit on the adjusting shaft and a cam unit on a camshaft. The lever unit is non-rotatably connected to the adjusting shaft, or can be non-rotatably connected to the adjusting shaft, by means of a coupling. The lever unit has a first lever arm and at least one further lever arm spaced apart axially and in the peripheral direction or with an angular offset relative to the adjusting shaft. The cam unit is non-rotatably connected to the camshaft, or can be non-rotatably connected to the camshaft, by means of a coupling. At least one cam with an outer contour is provided on the cam unit. Each of the lever arms that are spaced apart axially and with an angular offset on the adjusting shaft can be brought into an operative connection with at least one cam of the cam unit. Accordingly, the adjusting shaft is rotated by the camshaft by means of the lever unit on the adjusting shaft and the cam unit on the camshaft.

For this purpose, an axial displacement of the lever unit on the adjusting shaft and the cam element on the camshaft in relation to one another is necessary to bring a lever arm of the lever element into an operative connection with a cam of the cam element, the lever unit being axially displaceably mounted on the adjusting shaft and/or the cam unit being axially displaceably mounted on the camshaft.

In an advantageous configuration, the lever unit is axially displaceably mounted on the adjusting shaft and/or the cam unit is axially displaceably mounted on the camshaft and the corresponding counterpiece of the operative connection is axially non-displaceably positioned on the respective shaft. Alternatively, the two units can also be displaced relative to one another in order to further reduce the axial installation space requirement.

A contact is produced between a lever arm on the lever unit and a cam on the cam unit for the operative connection. At least one lever arm is provided on the lever unit and at least one cam is provided on the cam unit. At least one cam is provided with a rising outer contour. The rising outer contour is defined by the enlargement of a radial spacing of the outer contour with an increasing rotation angle in the rotational direction relative to the shaft. As a result, a rising outer contour in the form of a ramp with a starting radius, with an end radius and an angular range located in between is formed, within which the radius of the outer contour increases from the starting radius to the end radius.

If a lever arm of the lever unit on the adjusting shaft is brought into an operative connection with a cam of the cam unit, the at least one lever arm of the lever unit and the at least one cam of the cam unit are supported in relation to one another in that the respective outer contours are brought into contact. This contact between the outer contours of the lever arm and cam can be configured as a frictional or sliding contact and/or as a rolling contact, in which the outer contours slide and/or roll on one another.

At least one lever arm is provided with an outer contour, which is configured as a suitable counter-contour or as a suitable mechanism. In this case, a frictional contact or sliding contact or else a rolling contact may be provided for the outer contour. For example, an outer contour rising in the opposite direction or falling in the rotational direction, a radius or any other desired contour or rolling body, such as at least one cylinder, roller or ball, can be used on the lever for the contact with the outer contour of the cam. An outer contour rising in the opposite direction is advantageously provided according to the invention. The outer contour rising in the opposite direction is defined by the reduction in a radial spacing of the outer contour with an increasing rotation angle in the rotational direction relative to the shaft. An outer contour rising in the opposite direction in the form of a ramp with a starting radius, with an end radius and with an angular region located in between is thereby formed, within which the radius of the outer contour reduces from the starting radius to the end radius.

The outer contour of the cam is brought into contact with the outer contour of the lever arm by the axial displacement of the at least one lever arm and the at least one cam in relation to one another and the rotation of the camshaft and accordingly of the cam unit. Before the outer contours come into contact, the adjusting shaft is at rest, so the spacing of the outer contours can only be reduced by the rotation of the outer contour on the at least one cam of the cam unit. Provided for this purpose, at least on the cam of the cam unit, is a rising outer contour, the radius of which increases owing to the rotation of the camshaft in the contact region until the spacing of the outer contours is reduced as appropriate and the outer contours come into operative contact in the contact region.

The transmission of the rotational movement takes place by means of the non-rotatable connection of the cam unit to the camshaft and the non-rotatable connection of the lever unit to the adjusting shaft. The rotational movement is transmitted from the camshaft to the adjusting shaft with a corresponding transmission ratio owing to the operative connection of the outer contours that are in contact, the rotational directions of the two shafts being in the opposite direction.

The lever arm of the lever unit with the adjusting shaft, which is brought into an operative connection with a cam of the cam unit, carries out a rotational movement in the process for as long as the outer contours are in an operative connection. In accordance with the configuration, in particular the length and/or the rise of the rising outer contour on the cam and the outer contour rising in the opposite direction, mentioned by way of example, on the lever arm, the adjusting shaft is rotated about a specific angle by the rotation of the camshaft. The rise of the outer contours can be constant or variable here, the rise of the two outer contours of the cam and the lever arm having to be matched to one another.

According to the an embodiment of the invention, the rising outer contour of the cam and the outer contour of the lever arm rising in the opposite direction are advantageously configured in accordance with the length and the rise in such a way that at each operative connection, a rotation of the cam shaft about a predetermined drive angle, for example two hundred and forty degrees, and a rotation of the adjusting shaft about a predetermined adjusting angle, for example forty five degrees, is achieved. For this purpose, from the beginning to the end of the operative connection in the contact region, an angular range of two hundred and forty degrees is passed over by the rising outer contour of the cam and an angular range of forty five degrees is passed over by the outer contour rising in the opposite direction. A corresponding adaptation to the valve train or to the mode of operation of the internal combustion engine is possible by other combinations of the drive angle and adjusting angle.

Two operative connections are necessary for a rotation of the adjusting shaft required for the switchable valve train about, for example, ninety degrees. Therefore, at least one further, second cam, which is spaced apart from a first cam in the axial direction, is provided on the cam unit. According to an embodiment of the invention, the two cams may advantageously additionally be spaced apart in the peripheral direction. Analogously to this, at least one further, second lever arm is provided on the lever unit, which lever arm is spaced apart from a first lever arm in the axial direction and in the peripheral direction. According to an embodiment of the invention, the second lever arm advantageously adjoins the first lever arm in the peripheral direction.

Apart from a first operating plane of the first cam and the first lever arm, a second operating plane is formed with the second cam and the second lever arm, which are axially spaced apart from one another. Owing to the second cam or second lever arm spaced apart in the peripheral direction from the first cam or the first lever arm, a second operative connection between the second cam and second lever arm is produced in the rotational direction temporally after a first operative connection of the first cam and first lever arm. During the axial alignment of the cam unit with respect to the lever unit, both the first and the second operating planes are produced, the operative connections of the respective operating planes being produced temporally consecutively in accordance with the outer contours offset in the peripheral direction. Accordingly, a rotation of the adjusting shaft, for example about twice forty five degrees is brought about for each operating plane or each operative connection, in other words a total of ninety degrees, by the multiple arrangement of the cam and lever arms during a single alignment of the cam unit and lever unit.

An adjusting shaft actuation of a valve train for internal combustion engines is produced, with at least one cam unit, which is non-rotatably arranged on the cam shaft, with at least one cam, which is rigidly connected to the cam unit, on which an outer contour rising in the rotational direction is placed, and with at least one lever unit, which is non-rotatably arranged on an adjusting shaft, with at least one lever arm, which is rigidly connected to the lever unit, with an outer contour, which is configured as a suitable counter-contour or as a suitable mechanism for a frictional contact or sliding contact or a rolling contact, and the at least one cam can be brought into an operative connection with the at least one lever arm by an axial alignment between the cam unit and lever unit, the two outer contours of the cam and lever arm undergoing an operative connection. Two operative connections are provided for the adjusting shaft actuating device, a second cam spaced apart from a first cam in the axial direction and peripheral direction being provided on the cam unit and a second lever arm spaced apart from a first lever arm in the axial direction and in the peripheral direction being provided on the lever unit, and it being possible to produce a first operative connection of the first cam and first lever arm and a second operative connection of the second cam and second lever arm temporally consecutively during the rotation of the adjusting shaft.

According to an embodiment of the invention, the outer contour of the lever arm is advantageously configured as an outer contour rising in the opposite direction, rising outer contours and outer contours rising in the opposite direction in each case being defined, with respect to the length and radius course, by a starting radius, an end radius and an angular region located in between, a rise between the starting radius and end radius being able to be constant or variable, so the adjusting shaft can be rotated by ninety degrees with a single alignment of the cam unit and lever unit and by the rotation of the camshaft by four hundred and eighty degrees. The at least one cam is arranged on the camshaft so as to be spaced apart from each further cam axially and in the peripheral direction.

The aforementioned arrangement of cams and lever arms is repeated accordingly for a further complete rotation of the adjusting shaft by three hundred and sixty degrees in four rotation steps that are separated from one another of, in each case, ninety degrees, each rotation step being able to be triggered separately and sequentially. For this purpose, further lever arms are provided, with which a third, fourth, fifth, sixth, seventh and eighth operative connection can be formed. The lever arms are arranged in such a way that no continuing rotation of the adjusting shaft is produced. For this purpose, the lever arms are axially spaced apart from one another in such a way that after a rotation step, no further lever arm can undergo an operative connection with one of the cams. Owing to the axial alignment of the cam unit relative to the lever unit, the first cam of the cam unit can either be brought with a first, third, fifth or seventh lever arm of the lever unit, or the second cam can be brought with a second, fourth, sixth or eighth lever arm, into the corresponding first, second, third, fourth, fifth, sixth, seventh or eighth operative connection. Accordingly, eight operating planes are produced. Owing to the advantageous configuration or arrangement of the lever arms, only one rotation step is carried out for each alignment of the cam unit and lever unit in relation to one another. If a further rotation step is to be carried out, a new alignment of the cam unit and lever unit in relation to one another is necessary.

To save axial installation space, the lever arms are advantageously positioned for this purpose, according to an embodiment of the invention, on the lever unit in such a way that four operating planes at a mutual axial spacing, each with two lever arms, are formed, the lever arms being arranged offset by one hundred and eighty degrees in an operating plane in the peripheral direction.

As a result, a switching process is, for example, produced for the rotation of the adjusting shaft, in which a first alignment of the cam unit with the first cam and the second cam and of the lever unit with the first lever arm and the second lever arm in relation to one another forms a first operating plane with a first operative connection of the first cam and first lever arm and a second operating plane of the second cam and second lever arm. By means of the rotation of the camshaft, the first operative connection of the first cam and first lever arm is firstly produced and temporally thereafter, the second operative connection of the second cam and second lever arm is produced. As a result, the adjusting shaft is rotated by, for example, ninety degrees. As no further lever arm can then undergo an operative connection with one of the cams, the adjusting shaft remains stationary.

For the further rotation of the adjusting shaft, a second alignment of the cam unit with the first cam and the second cam and of the lever unit with the third lever arm and the fourth lever arm in relation to one another is formed and a third operating plane with the third operative connection of the first cam and the third lever arm and a fourth operating plane with the fourth operative connection of the second cam and fourth lever arm are formed. Owing to the rotation of the camshaft, the third operative connection of the first cam and third lever arm is firstly produced and temporally thereafter, the fourth operative connection of the second cam and fourth lever arm is produced. As no further lever arm can then in turn undergo an operative connection with one of the cams, the adjusting shaft remains stationary.

For the further rotation of the adjusting shaft, the first alignment of the cam unit with the first cam and the second cam and of the lever unit with the fifth lever arm and the sixth lever arm is again formed in relation to one another and the first operating plane with the fifth operative connection of the first cam and the fifth lever arm as well as the second operating plane with the sixth operating connection of the second cam and sixth lever arm are formed. Owing to the rotation of the camshaft, the fifth operative connection of the first cam and fifth lever arm is firstly produced and, temporally thereafter, the sixth operative connection of the second cam and sixth lever arm is produced. As no further lever arm can then in turn undergo an operative connection with one of the cams, the adjusting shaft remains stationary.

For the further rotation of the adjusting shaft, the second alignment of the cam unit with the first cam and the second cam and of the lever unit with the seventh lever arm and the eighth lever arm is formed in relation to one another and the second operating plane with the seventh operating connection of the first cam and seventh lever arm as well as the fourth operating plane with the eighth operating connection of the second cam and eighth lever arm are formed. Owing to the rotation of the camshaft, the seventh operative connection of the first cam and seventh lever arm is produced and temporally thereafter, the eighth operative connection of the second cam and eighth lever arm is produced. As no further lever arm can then in turn undergo an operative connection with one of the cams, the adjusting shaft remains stationary, the adjusting shaft then having carried out a complete rotation for the exemplary switching process.

Owing to the changing alignment of the cam unit and the lever unit between the first and second alignment in relation to one another, the adjusting shaft can in each case be further rotated by a rotation step.

The axial displacement to orient the cam unit and lever unit in relation to one another can take place by various measures. In an advantageous manner according to an embodiment of the invention, the switching over takes place by means of a switching gate on the unit to be displaced and at least one pin, which is introduced into the switching gate by means of an actuator. The pin is positioned fixed to the housing and, owing to the axial stroke of the switching gate, brings about an axial displacement of the unit to be displaced, in other words the cam unit and/or the lever unit. Alternatively, a magnet switching device can also be used, for example, which allows an axial displacement. These and further known mechanisms for axial displacement can either be arranged on the cam unit and/or on the lever unit.

An advantage of embodiments of the invention is that with a low outlay and a low required installation space, a reliable rotation of the adjusting shaft and therefore a reliable switching over of the valve stroke take place. Individual features of the invention can be combined to form new sensible combinations.

Figure 2:
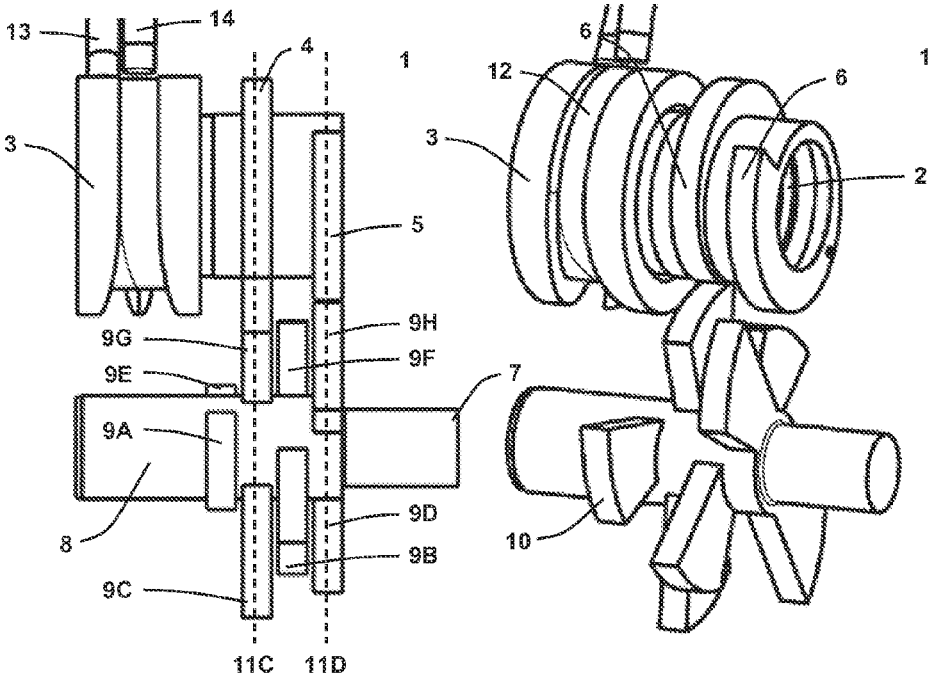

An adjusting shaft actuating device 1 of a valve train for an internal combustion engine is equipped with a cam unit 3 non-rotatably arranged on the camshaft 2 with two cams 4, 5 angularly offset axially and in the peripheral direction and rigidly connected to the cam unit, on which a respective rising outer contour 6 is placed. The adjusting shaft actuating device 1 furthermore comprises a lever unit 8, which is non-rotatably arranged on an adjusting shaft 7, with eight lever arms 9, which are rigidly connected to the lever unit and angularly offset in the peripheral direction and on which an outer contour 10 rising in the opposite direction is in each case placed (FIG. 1, FIG. 2). By means of an axial alignment of the cam unit 3 relative to the lever unit 8, a first cam 4 of the cam unit can either be brought with the first, third, fifth or seventh lever arm 9A, 9C, 9E, 9G of the lever unit 8, or a second cam 5 of the cam unit 3 can be brought with the second, fourth, sixth or eighth lever arm 9B, 9D, 9F, 9H into the corresponding first, second, third, fourth, fifth, sixth, seventh or eighth operative connection, so that four operating planes 11 at a mutual axial spacing are each formed with two lever arms 9, the lever arms 9 in an operating plane 11 being arranged offset in the peripheral direction by one hundred and eighty degrees and by forty five degrees in relation to the lever arms 9 of one of the three further operating planes 11 in the peripheral direction.

The axial displacement to orient the cam unit 3 and the lever unit 8 in relation to one another is achieved by a switching gate 12 on the cam unit 3 and two pins 13, 14, the pins 13, 14 being introduced into the switching gate 12 by means of an actuator for the respective alignment in an alternating manner. The pins 13, 14 are positioned fixed to the housing and, owing to the axial stroke of the switching gate 12, bring about an axial displacement of the cam unit 3 in relation to the lever unit 8, so that, in a first alignment (FIG. 1), a first operating plane 11A with the first cam 4 and first lever arm 9A and a second operating plane 11B with a second cam 5 and second lever arm 9B or the first operating plane 11A with the first cam 4 and fifth lever arm 9E and the second operating plane 11B with the second cam 5 and sixth lever arm 9F form, or in a second alignment (FIG. 2), a third operating plane 11C with the first cam 4 and third lever arm 9C and a fourth operating plane 11D with the second cam 5 and fourth lever arm 9D or the third operating plane 11C with the first cam 4 and seventh lever arm 9G and a fourth operating plane 11D with the second cam 5 and eighth lever arm 9H form.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 adjusting shaft actuating device
2 camshaft
3 cam unit
4 first cam
5 second cam
6 rising outer contour
7 adjusting shaft
8 lever unit
9, 9A, 9B, 9C, 9D, 9E, 9F, 9G, 9H lever arm, first, second, third, fourth, fifth, sixth, seventh, eighth
10 outer contour rising in the opposite direction
11, 11A, 11B, 11C, 11D operating plane, first, second, third, fourth
12 switching gate

What is claimed is:

1. An adjusting shaft actuating device of a valve train for internal combustion engines, the device comprising:

at least one cam unit non-rotatably arranged on the camshaft with at least one cam including first and second cams rigidly connected to the cam unit, each cam including an outer contour rising in a rotational direction and the second cam being spaced apart from the first cam in an axial direction and a peripheral direction; and at least one lever unit non-rotatably arranged on an adjusting shaft with at least one lever arm and including first and second lever arms rigidly connected to the lever unit, each lever arm including an outer contour and the second lever arm being spaced apart from the first lever arm in an axial direction and a peripheral direction, wherein, by an axial alignment between the at least one cam unit and the at least one lever unit, the first cam is configured to be brought into a first operative connection with the first lever arm and the second cam is configured to be brought into a second operative connection with the second lever arm, and wherein the first and second cams and first and second lever arms are arranged such that the first operative connection of the first cam and first lever arm and the second operative connection of the second cam and second lever arm are produced during a rotation of the adjusting shaft in a temporally consecutive manner.

2. The adjusting shaft actuating device according to claim 1, wherein the outer contour of each lever arm is configured as an outer contour rising in an opposite direction, wherein the rising outer contours and outer contours rising in the opposite direction are in each case defined, with respect to a length and radius course, by a starting radius, an end radius and an angular region located in between, a rise between the starting radius and end radius being able to be constant or variable, so that with a single orientation of the cam unit and lever unit and by a rotation of the camshaft by four hundred and eighty degrees, the adjusting shaft can be rotated by ninety degrees.

3. The adjusting shaft actuating device according to claim 1, wherein each cam is arranged on the cam unit so as to be spaced apart axially and in the peripheral direction from a further cam.

4. The adjusting shaft actuating device according to claim 1, wherein each lever arm is arranged on the lever unit so as to be spaced apart, at least in the peripheral direction, from each further lever arm.

5. The adjusting shaft actuating device according to claim 1, wherein the at least one cam includes a plurality of cams arranged so as to be distributed in the peripheral direction on the cam unit and axially spaced apart from one another, and the at least one lever arm includes a plurality of lever arms arranged so as to be distributed in the peripheral direction on the lever unit.

6. The adjusting shaft actuating device according to claim 1, wherein the at least one lever arm includes eight lever arms so as to provide a first, second, third, fourth, fifth, sixth, seventh and eighth operative connection, the lever arms being arranged in such a way that no continuing rotation of the adjusting shaft can be produced, wherein, by an axial orientation of the cam unit relative to the lever unit, the first cam of the cam unit can either be brought with the first, third, fifth or seventh lever arm of the lever unit, or the second cam of the cam unit can be brought with the second, fourth, sixth or eighth lever arm, into the corresponding first, second, third, fourth, fifth, sixth, seventh or eighth operative connection, so that four operating planes at a mutual axial spacing are each formed with two lever arms, the lever arms being arranged offset in an operating plane in the peripheral direction by one hundred and eighty degrees and with respect to the lever arms of one of the three further operating planes by forty five degrees in the peripheral direction.

7. The adjusting shaft actuating device according to claim 6, wherein for a rotation of the adjusting shaft, the cam unit and the lever unit are configured to be brought into a first alignment with respect to one another and form a first operating plane with the first operative connection of the first cam and first lever arm and a second operating plane with the second operative connection of the second cam and second lever arm or the first operating plane with the fifth operative connection of the first cam and fifth lever arm and the second operating plane with the sixth operative connection of the second cam and sixth lever arm, or can be brought into a second alignment and form a third operating plane with the third operative connection of the first cam and third lever arm and a fourth operating plane with the fourth operative connection of the second cam and fourth lever arm or the third operating plane with a seventh operative connection of the first cam and seventh lever arm and a fourth operating plane with the eighth operative connection of the second cam and eighth lever arm.

* * * * *